United States Patent [19]

Prescher

[11] Patent Number: 4,589,649

[45] Date of Patent: May 20, 1986

[54] OSCILLATING SHEET SEPARATING SUCTION HEAD ON PARALLELOGRAM LINKAGE

[75] Inventor: Dieter Prescher, Leipzig, German Democratic Rep.

[73] Assignee: VEB Kombinat Polygraph "Werner Lamberz" Leipzig, Leipzig, German Democratic Rep.

[21] Appl. No.: 633,094

[22] Filed: Jul. 20, 1984

[30] Foreign Application Priority Data

Sep. 16, 1983 [DD] German Democratic Rep. ..... 2548605

[51] Int. Cl.[4] ..... B65H 3/08

[52] U.S. Cl. ..... 271/107; 271/104; 414/917

[58] Field of Search ..... 271/107, 93, 91, 92, 271/98, 104, 105; 414/120, 121, 733, 917

[56] References Cited

U.S. PATENT DOCUMENTS 1,249,042 12/1917 Dexter et al. ..... 271/107 X
3,199,863 8/1965 Müller ..... 414/121 X
3,586,314 6/1971 Samoggia ..... 271/93 X

FOREIGN PATENT DOCUMENTS 717654 2/1942 German Democratic Rep.
42850 1/1966 German Democratic Rep.
80719 11/1971 German Democratic Rep.
2423349 8/1975 German Democratic Rep.

*Primary Examiner*—Bruce H. Stoner, Jr.
*Assistant Examiner*—M. C. Graham
*Attorney, Agent, or Firm*—Michael J. Striker

[57] ABSTRACT

A sheet-separating device for separating individual sheets from a stack, for example in the printing machine includes pneumatically operated suction heads engageable with the uppermost sheet of the stack, a four-link transmission device effecting a vertical movement of the suction heads relative to the stack and having a swinging arm connected to the suction heads, and an oscillating device including a pivotable connecting rod connected to the suction heads, and a vertical slide connected to the connecting rod so that a limited oscillating horizontal movement is imparted to the suction heads in addition to the vertical movement.

5 Claims, 3 Drawing Figures

OSCILLATING SHEET SEPARATING SUCTION HEAD ON PARALLELOGRAM LINKAGE

BACKGROUND OF THE INVENTION

The present invention relates to a device for separating sheets from a sheet stack in general, and more particularly this invention relates to a sheet-separating device for separating printed sheets from a stack by means of cam-controlled or pneumatically controlled suction devices in paper-processing machines, for example printing machines.

One of conventional sheet-separating device has been disclosed in German patent DD PS No. 80 719. The known device includes a roller supported in the stationary frame of the device and operated to drive, via a roller lever, a four-link power transmission. The suction head in this known device is movable by the four-link transmission such that a curved movement of the suction head is approximately adjusted to a vertical; in other words an approximately uniform angular adjustment of the suction head to the upper surface of the paper to be separated from the stack has been ensured. The disadvantage of this known sheet-separating device is that each sheet to be removed, and particularly the ridge formed at the rear edge of the stack becomes adhered to the following sheets thereby preventing the normal separation of the sheets from the stack because each sheet can cause a lifting movement and an insignificant horizontal movement of the following sheet in the stack. Despite the utilization of various known rubbing-off elements, such as wipers or the like, double-sheets have been constantly separated from the stack. The adjustment of the position of the suction head to the upper surface of the stack has been obtained in the known device by an additional double-parallelogram suspension of the suction head so that the adjustment of the angular position of the suction head about an adjustable pivot point on the stationary frame could be achieved. The once adjusted angular position was maintained but not for the entire working stroke uniformly and thus not for the entire sheet-separating process.

Another sheet-separating device is disclosed in German patent publication DE-AS No. 24 23 349. This known device enables an angular adjustment of the suction head in the sheet-conveying direction and also in the transversal direction. The suction nozzle is movably positioned in the longitudinal direction of the sheet stack and is adjusted relative to the vertical axis by an adjusting screw engaged with and releasably supported on the upper end of the suction head by a knurled nut. The suction head thereby pivots over a predetermined curved path and the adjustment of its vertical position results to align the sheets, which lie non-parallel to the guide rails during the movement of the suction head. The respective adjustment of the horizontal surface of the suction head to the upper surface of the sheet stack results in this construction in that the sheets arrive at the conveyor marks in different positions. A combination of various cyclic movements in one stroke interval has been, however non-realizable in this conventional device.

Still another known device of the type under consideration has been described in German patent DD-PS No. 42 850. A reliable sheet-separation has been accomplished in this known device by providing a sudden tilting movement of the suction head about the edge of the suction head and by a subsequent impact-like lifting of the suction head from the stack. These movements, however could not provide for desired results in separating sheets from the stack because the impactwise movements of the suction head, effected by pneumatically-operated elements, caused the suction effect which led to pulling off the following sheet together with the sheet being separated. The adjustment of the suction head to the existing upper surface of the stack during the operation of the printing machine has not been, however, possible.

The German patent DD-PS No. 717, 654 discloses a movable-up- and down carrier, at the lower end of which a cam-controlled four-link transmission is provided, having a coupling member connected to the sheet-separating suction head. The adjustable coulisse guide imparts to the coupling member and to the suction head therewith, an adjustable tilting movement. The horizontal movement of the suction head is avoided in this known device in order to prevent sheet pulling during the tilting movement of the suction head.

SUMMARY OF THE INVENTION

It is an object of the present invention to provide a sheet-separating device for a printing machine in which the above indicated disadvantages of conventional sheet-separating arrangement are avoided.

It is a further object of this invention to provide an improved sheet-separating device in which a reliable sheet-separation in very short periods of time would be provided and pulling off double-sheets from the stack would be avoided.

It is still another object of the invention that, while being new and effective the invention employs the known cam-controlled four-link transmission.

It is yet another object of the present invention to provide a sheet-separating device, in which the operation of the suction device is improved because of imparting to the suction device of a new movement sequence.

It is yet a further object of this invention to provide a sheet-separating device in which the position of the suction device is adjustable relative to the existing upper surface of the sheet stack during the operation of the machine.

And still a further object of the invention is to provide a transmission mechanism which can be applied in the sheet-separating device without high expenses.

These and other objects of this invention are attained by a sheet-separating device comprising a suction head engageable with an uppermost sheet of a sheet stack and vertically movable to separate the uppermost sheet from the stack; a suction tube, said suction head being rigidly connected to said suction tube; driven four-link transmission means connected to said suction tube; and means for imparting an additional oscillating and horizontal movement to said suction head, said imparting means being straight-stroke crank transmission oscillating means and including a transmission portion which is the portion of said four-link transmission means.

The sheet-separating device may further include at least one guide rod rigidly interconnected between said suction head and said suction tube, and said oscillating means may include a driven crank, which is the portion said four-link transmission means, a connecting rod connected to said guide rod, a slidable bar pivotally connected to said connecting rod, and a guide in which said bar is vertically slidable, whereby said guide rod together with said connecting rod are pivoted so that the suction head during its vertical movement performs an oscillating movement over a curved path.

The driven crank may be a cam-controlled oscillating arm.

The guide rod may be rigidly or adjustably connected to the connecting rod.

The sheet-separating device according to the present invention may further include a stationary frame, said guide being adjustable in said frame in the direction which is perpendicular to the slidable movement of said slidable bar.

It is specifically advantageous in the sheet-separating device of this invention that a reliable separation of the uppermost sheet, and particularly the following sheet from the stack is ensured. Due to the complex movement of the suction head, which includes simultaneously performed lifting component, oscillating component and horizontal to-and-fro movement, a harmonious sheet-separating results, which is realized in very short periods of time and ensures that the edges of the sheets remaining in the stack, after the uppermost sheet has been removed from the stack, remain parallel to each other in their initial position. It is also advantageous that the transmission device according to the present invention can be utilized with the existing sheet-separating devices. The adjustment of the lower surface of the suction head to the upper surface of the sheet stack near the rear edge thereof presents no problems and is carried out during the operation of the machine.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DETAILED DESCRIPTION OF THE PREFERRED EMBODIMENTS

Figure 1:
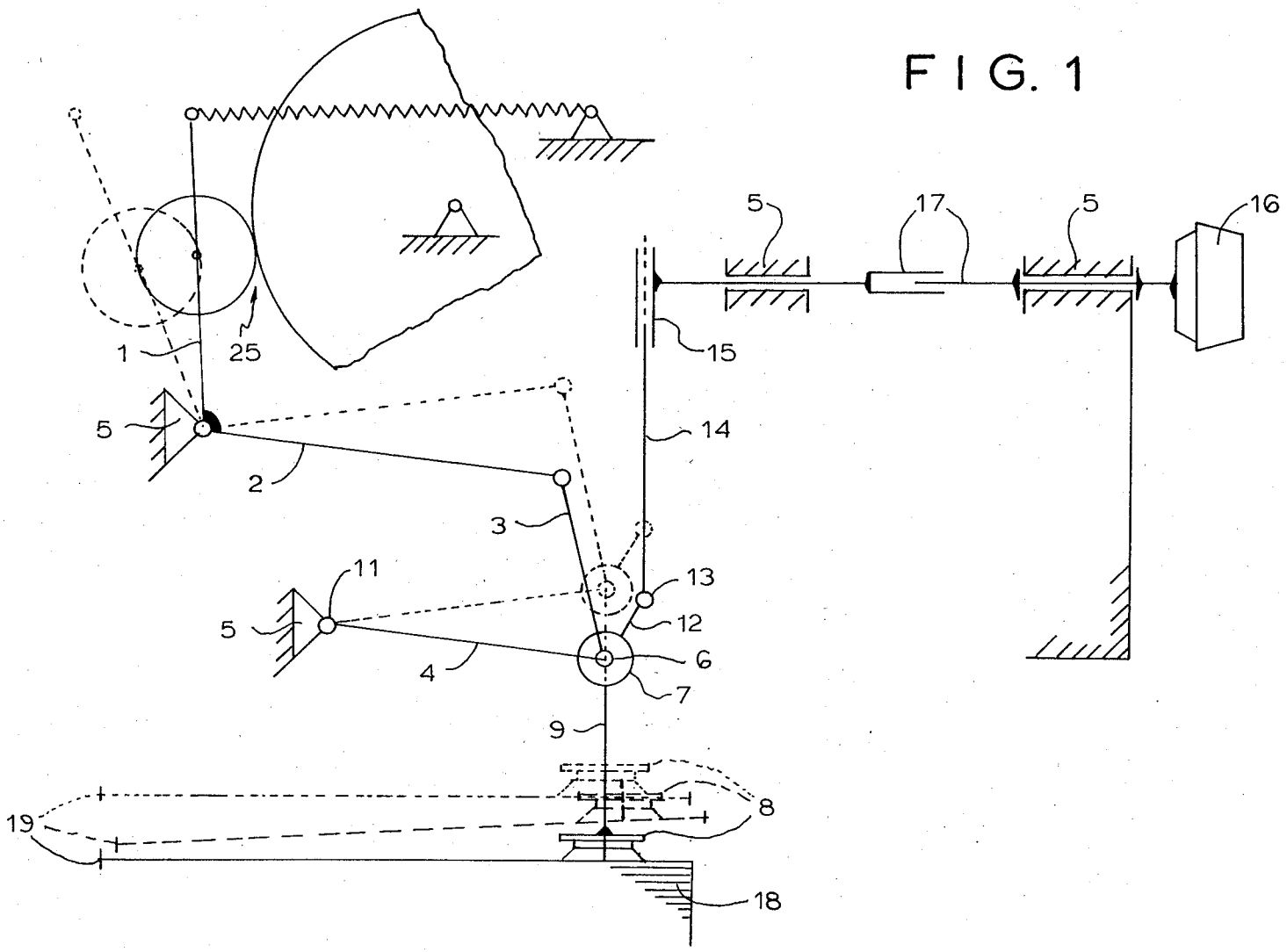
FIG. 1 is a schematic illustration of a power transmission device for causing a sheet-separating movement of the sheet-separating suction head, according to the invention, in the case of the horizontal position of the upper surface of the sheet stack.

Referring now to the drawings in detail, it will be seen that the power transmission device according to the invention includes a roller lever 1, which is connected to a conventional cam drive or the like, from which a driven crank 2 is movable relative to a stationary frame 5. The driven crank 2 together with a connecting rod 3, a driven crank 4 and frame 5 form a four-link power transmission. Connecting or coupling rod 3 and driven crank 4 are connected to each other by a joint 6. This joint is embraced with a suction tube 7 connected to a non-illustrated suction air-generator. Sheet-separating suction devices or heads 8 are rigidly connected, by means of guide rods 9, to the elongated suction tube 7. One, or two, or a number of suction devices 8 can be provided in the present invention. It is, of course, understood that in the event that many suction heads are arranged on the suction tube they are uniformly distributed over the length of the tube to uniformly grip the uppermost printed sheet 19 from a stack of sheets 18.

Figure 2:
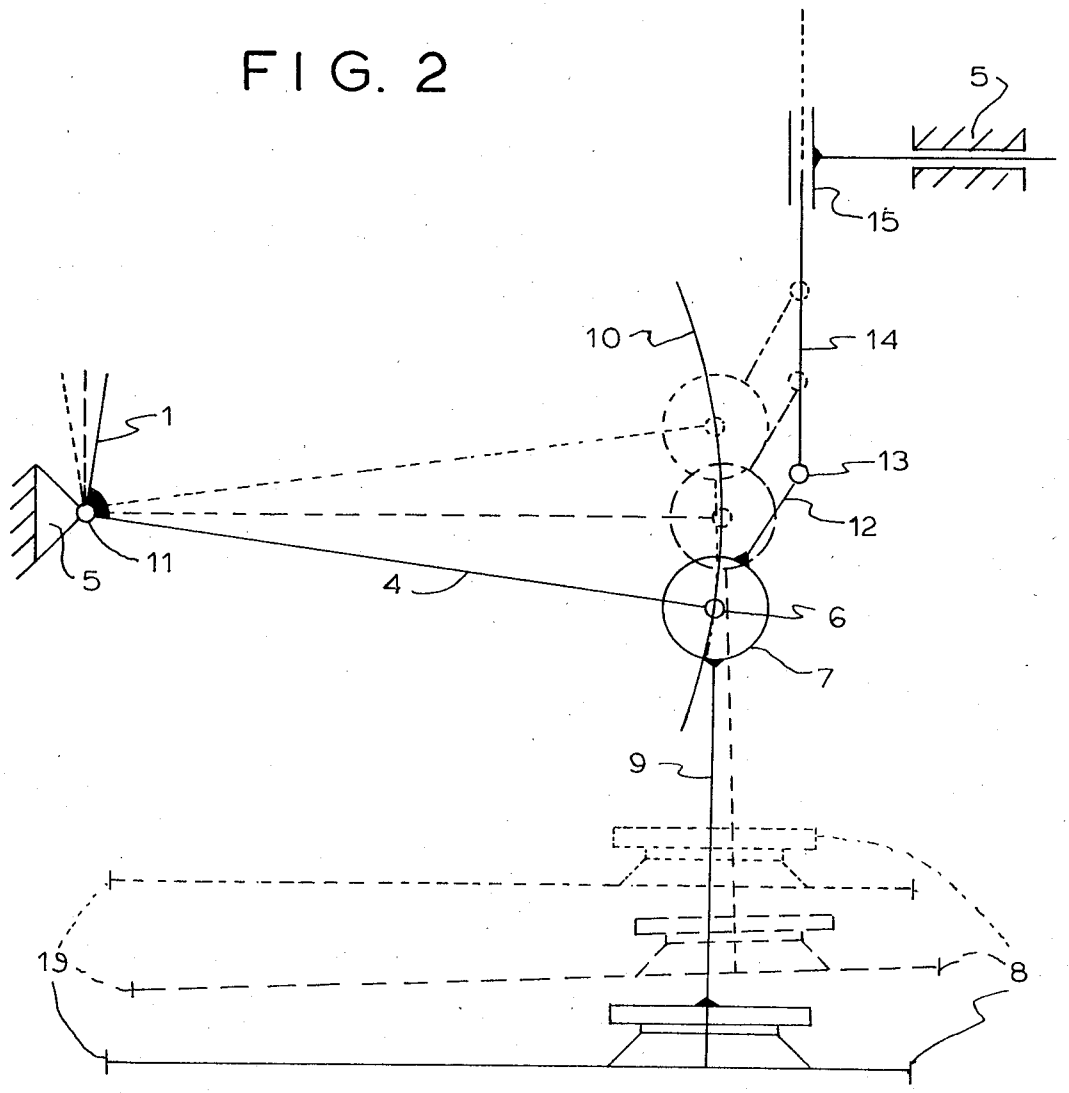
FIG. 2 is an enlarged section of FIG. 1, illustrating various phases of the sheet-separating movement of the transmission device including an oscillating drive member.

With reference to FIG. 2 it will be seen that the tube 7 is movable over a curved or circular path 10 about a joint or pivot axle 11, at which the driven crank 4 is connected to frame 5. Guide rods 9 are rigidly secured to the outer surface of tube 7 by any suitable conventional means. In order to enhance the variability of the movements of the suction heads 8 guide rods 9 can be, together with tube 7, connected to a further connecting rod 12. The latter can also be rigidly secured to the outer surface of tube 7, as shown in the drawing. The opposite end of connecting rod 12 is connected, via a joint 13, to a sliding bar 14 slidably movable in a guide 15 which is adjustably supported in frame 5 in the direction normal to the axis of movement of the sliding bar 14. For this purpose, an adjusting knob 16 is provided, positioned externally of the frame 5, which is a stationary housing of the sheet-separating device. Adjusting knob 16 affects the adjustment of guide 15 by the actuation of a thread connection 17.

Upon the actuation of the non-illustrated cam drive 25 one or a plurality of sheet-separating suction heads 8 are slightly brought into contact with the sheet stack 18, engage the uppermost sheet 19 and are vertically lifted over the course, which subsequently has a horizontal movement component when no movement is forced upon the tube 7 via the coupling with the sliding bar 14; each suction head 8 then swings about the joint 6 and simultaneously performs a horizontally directed movement opposite to a further raising of the sheet. The uppermost sheet 19 is therefore gradually and in a harmonious manner lifted by means of the cam drive and additionally tilts and oscillates horizontally by means of the additional power transmission means. All the movements take place in an extremely short period of time.

Figure 3:
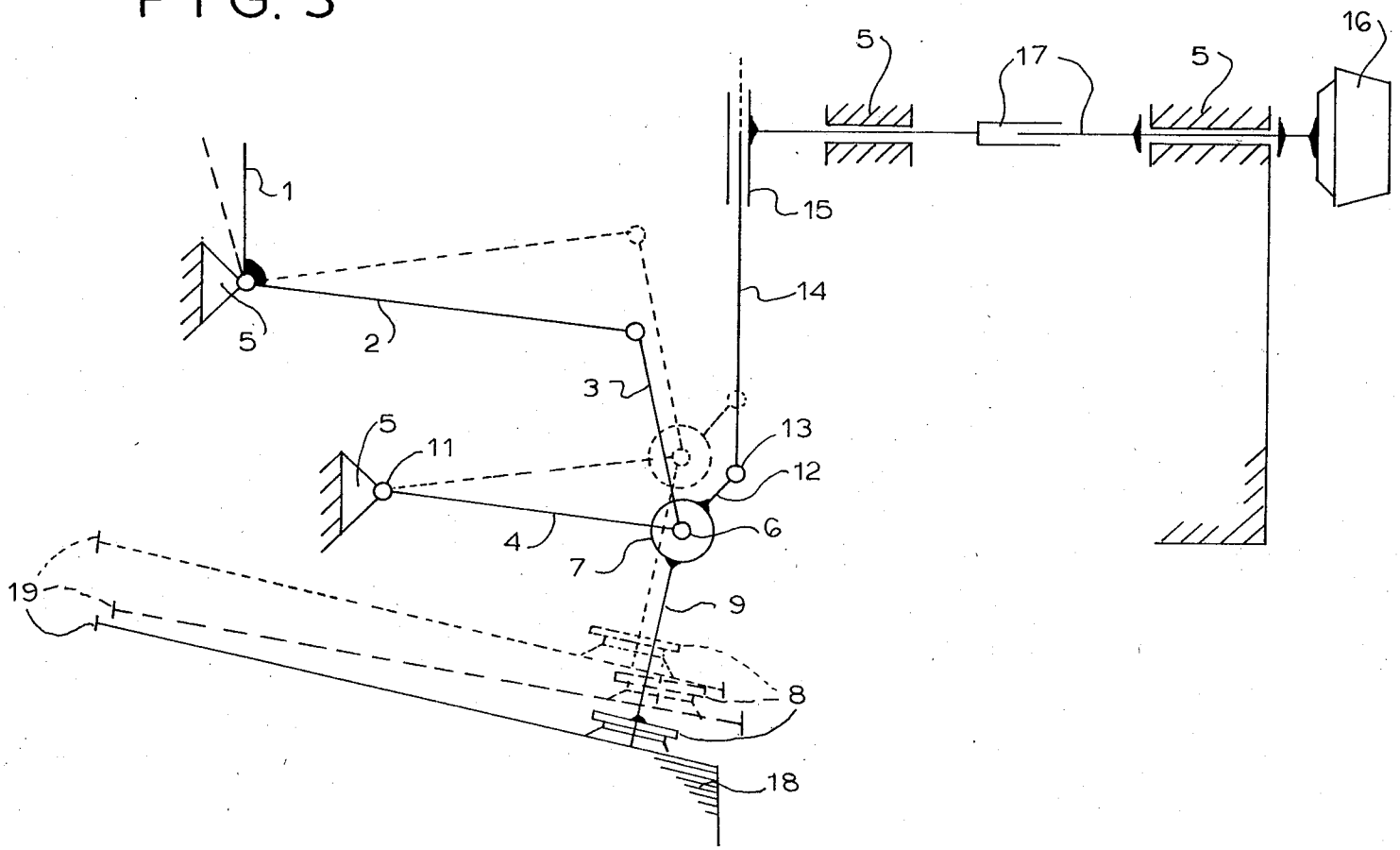
FIG. 3 is a schematic illustration of the power transmission device of FIG. 1 in the position, in which the sheet-seperating suction device is adjusted to the inclined upper surface of the sheet stack.

With reference to FIG. 3 it will be seen that it is possible in practice that the rear portion of the sheet stack 18 will not lie exactly horizontally. The utilization of wedges or the like has been often unsuitable for various reasons. There is a possibility, due to the provision of adjusting knob 16 and thread connection 17, that in case of deviation of the upper surface of the sheet stack from the precisely horizontal position during the operation, the position of guide 15 be adjusted such that joint 13 and the connecting rod therewith would take a different position. Thereby the position of the above described curve of the movement of the power transmission will be changed, and although the oscillating movement will be maintained the surface of the suction head applied onto the uppermost sheet will be simultaneously brought into the position which is parallel to the inclined upper surface of the sheet stack, so that a reliable engagement of the suction head with the uppermost sheet will result with a uniform movement of each suction head.

The proposed additional power transmission portion of the swinging straight-stroke transmission, namely connecting rod 12, sliding bar 14 etc., can additionally provide for a necessary freedom degree with the existing sheet-separating device, without loosening the tube 7 from the connecting rod 3. To provide for the movement path of the sheet-separating suction heads according to the invention a modified embodiment can be also suggested, for example in the case of manufacturing a new sheet-separating device; the four-link transmission can be modified, so that a rocking arm 4 of the oscillating straight-stroke transmission 4, 12, 14, 15 can be also directly, in the known fashion, driven by the non-illustrated cam as is the case in FIG. 2.

Of course, the swinging straight-stroke transmission 4, 12, 14, 15 can also be, within the limits of this invention, replaced by a cam transmission. The utilization of the straight-stroke crank transmission is specifically advantageous with high-speed sheet-separating devices because of relatively small movable masses.

It will be understood that each of the elements described above, or two or more together, may also find a useful application in other types of devices for separating sheets differing from the types described above.

While the invention has been illustrated and described as embodied in a device for separating sheets, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A sheet-separating device, comprising at least one sheet-separating suction head engageable with an uppermost sheet of a sheet stack and vertically movable to separate the uppermost sheet from the stack; a suction tube, said suction head being rigidly connected to said suction tube; a driven parallelogram linkage unit (2, 3, 4, 5) including four-links pivotally connected to each other of which a fourth link is connected to said suction tube, said parallelogram linkage unit imparting to said suction head a substantially vertical movement over a curved path so as to enable said suction head to come into contact with the uppermost sheet and vertically lift the latter; and oscillating means (4, 12, 14, 15) including a crank (4) pivotally connected to said suction head and being said fourth-link of said unit, a connecting rod rigidly connected to said suction tube, a slidable bar pivotally connected to said connecting rod, and a guide in which said bar is vertically slidable, whereby said oscillating means operate to impart to said suction head during said vertical lifting an additional oscillating movement in a horizontal direction.

2. The device as defined in claim 1, further including at least one guide rod (9) rigidly interconnected between said suction head and said suction tube, said connecting rod (12) being connected to said guide rod so that said guide rod together with said connecting rod are pivoted so that the suction head during its vertical movement performs said oscillating movement.

3. The device as defined in claim 2, wherein said crank (4) is a cam-controlled oscillating arm.

4. The device as defined in claim 2, wherein said guide rod is rigidly connected to said connecting rod.

5. The device as defined in claim 2, further including a stationary frame, said guide being adjustable in said frame in the direction which is perpendicular to the slidable movement of said slidable bar so as to adjust said suction head to a position of an upper surface of the sheet stack if said upper surface is deviated from a horizontal position.

* * * * *